US007156098B2

(12) United States Patent
Dolezal et al.

(10) Patent No.: US 7,156,098 B2
(45) Date of Patent: Jan. 2, 2007

(54) BREATHING AIR FILTRATION SYSTEM

(75) Inventors: David M. Dolezal, Edina, MN (US); John D. Wilder, Brooklyn Park, MN (US)

(73) Assignee: Dolezal Creative Innovations, LLC, Edina, MN (US)

( * ) Notice: Subject to any disclaimer, the term of this patent is extended or adjusted under 35 U.S.C. 154(b) by 153 days.

(21) Appl. No.: 10/804,995

(22) Filed: Mar. 19, 2004

(65) Prior Publication Data

US 2005/0205095 A1 Sep. 22, 2005

(51) Int. Cl.
*A61G 10/00* (2006.01)

(52) U.S. Cl. ..... 128/206.11; 128/204.11

(58) Field of Classification Search ..... 128/204.11, 128/204.12, 206.11, 207.18
See application file for complete search history.

(56) References Cited

U.S. PATENT DOCUMENTS

| | | | | | |
|---|---|---|---|---|---|
| 533,880 | A | * | 2/1895 | Forne | 128/203.23 |
| 701,538 | A | * | 6/1902 | Carence | 128/204.12 |
| 813,425 | A | * | 2/1906 | Hill | 128/203.23 |
| 1,071,015 | A | * | 8/1913 | Adler | 128/206.11 |
| 1,175,799 | A | * | 3/1916 | Niessner | 128/206.11 |
| 1,322,375 | A | * | 11/1919 | Un | 128/206.11 |
| 1,520,930 | A | * | 12/1924 | Calhoun | 128/206.11 |
| 1,823,094 | A | * | 9/1931 | Dylong | 128/204.12 |
| 2,057,397 | A | * | 10/1936 | Strauch | 128/204.13 |
| 2,097,846 | A | * | 11/1937 | Strauch | 128/204.13 |
| 2,151,227 | A | * | 3/1939 | Pawelek | 128/206.11 |
| 2,162,583 | A | * | 6/1939 | Kjellsson | 128/206.11 |
| 2,277,390 | A | * | 3/1942 | Crespo | 128/204.12 |
| 2,433,565 | A | * | 12/1947 | Korman | 128/204.12 |
| 2,535,155 | A | * | 12/1950 | Pandorf | 128/204.12 |
| 2,672,138 | A | * | 3/1954 | Carlock | 128/207.18 |
| 2,751,906 | A | * | 6/1956 | Irvine | 128/206.11 |
| 2,777,442 | A | * | 1/1957 | Zelano | 128/206.11 |
| 2,890,695 | A | * | 6/1959 | Safstrom | 128/206.11 |
| 3,451,392 | A | * | 6/1969 | Cook et al. | 128/206.11 |
| 3,457,917 | A | * | 7/1969 | Mercurio | 128/204.12 |
| 3,463,149 | A | * | 8/1969 | Albu | 128/204.12 |
| 3,722,509 | A | * | 3/1973 | Nebel | 128/204.12 |
| 3,747,597 | A | * | 7/1973 | Olivera | 128/206.11 |
| 3,884,223 | A | * | 5/1975 | Keindl | 128/206.11 |
| 3,905,335 | A | * | 9/1975 | Kapp | 128/206.11 |
| 4,030,491 | A | | 6/1977 | Mattila | |
| 4,052,983 | A | * | 10/1977 | Bovender | 128/204.12 |
| 4,220,150 | A | * | 9/1980 | King | 128/206.11 |
| 4,221,217 | A | * | 9/1980 | Amezcua | 128/206.11 |

(Continued)

OTHER PUBLICATIONS

T. J. O'Meara, et al., "The reduction of rhinitis symptoms by nasal filters during natural exposure to ragweed and grass pollen", Allergy 2005: 60: 529-532.

(Continued)

*Primary Examiner*—Aaron J. Lewis
(74) *Attorney, Agent, or Firm*—Dorsey & Whitney, LLP

(57) ABSTRACT

A nasal air filtration device includes a pair of concave-convex filters, and a support structure incorporating a pair of generally annular bases for supporting the filters, and a bridge that couples the bases, to maintain them in a desired spaced-apart relation and to determine a desired angular relationship between the bases and between the associated filters. The support structure is positionable against the anterior nares to direct the filters into their corresponding nasal cavities. The support structure maintains each of the filters in spaced-apart relation to the surrounding nasal wall. In alternative embodiments, an open frame is mounted to each base and positioned between its associated filter and the nasal wall.

33 Claims, 5 Drawing Sheets

U.S. PATENT DOCUMENTS

| | | | | | |
|---|---|---|---|---|---|
| 4,267,831 | A * | 5/1981 | Aguilar | 128/203.14 |
| 4,401,117 | A | 8/1983 | Gershuny | |
| 4,573,461 | A | 3/1986 | Lake | |
| 4,984,302 | A * | 1/1991 | Lincoln | 2/206 |
| 5,117,820 | A | 6/1992 | Robitaille | |
| 5,392,773 | A * | 2/1995 | Bertrand | 128/206.11 |
| 5,417,205 | A * | 5/1995 | Wang | 128/206.11 |
| 5,568,808 | A * | 10/1996 | Rimkus | 128/206.11 |
| 5,746,200 | A | 5/1998 | Draenert | |
| 5,775,335 | A * | 7/1998 | Seal | 128/848 |
| 5,787,884 | A | 8/1998 | Tovey | |
| 5,890,491 | A * | 4/1999 | Rimkus | 128/206.11 |
| 6,015,425 | A | 1/2000 | Altadonna, Jr. | |
| 6,109,262 | A | 8/2000 | Tovey | |
| 6,119,690 | A | 9/2000 | Pantaleo | |
| 6,213,121 | B1 | 4/2001 | Cardarelli | |
| D451,193 | S | 11/2001 | McCormick | |
| 6,386,197 | B1 * | 5/2002 | Miller | 128/206.11 |
| 6,494,205 | B1 * | 12/2002 | Brown | 128/206.11 |
| 6,701,924 | B1 | 3/2004 | Land, Jr. et al. | |
| 6,962,156 | B1 * | 11/2005 | Michaels | 128/206.11 |
| 2003/0106555 | A1 | 6/2003 | Tovey | |
| 2003/0106556 | A1 | 6/2003 | Alperovich et al. | |
| 2003/0209145 | A1 | 11/2003 | Soper | |
| 2004/0055603 | A1 | 3/2004 | Bruce | |
| 2004/0079814 | A1 | 4/2004 | Altadonna, Jr. | |
| 2004/0194784 | A1 | 10/2004 | Bertrand | |
| 2004/0211425 | A1 | 10/2004 | Wang | |
| 2004/0261798 | A1 | 12/2004 | Rimkus | |
| 2005/0061325 | A1 | 3/2005 | Michaels | |
| 2005/0066972 | A1 | 3/2005 | Michaels | |
| 2005/0066973 | A1 | 3/2005 | Michaels | |

OTHER PUBLICATIONS

Medical Device Company Focused Initially on Preventing Hay Fever, The University of Sydney Business Liaison Office, Commercialisation; *Forum & Fair of Ideas;* Sydney 26-28 Mar. 2003.

* cited by examiner

BREATHING AIR FILTRATION SYSTEM

BACKGROUND OF THE INVENTION

The present invention relates to devices and systems for filtering ambient air as it is inhaled, and more particularly to filtration devices and systems that employ filtering media and filtering components insertable into the nasal cavities.

There is an increasing need for effective filtration of breathing air, to reduce inhaled quantities of particulates and contaminants such as dust and pollen. In cities and other densely populated regions, there is a greater need for filtering pollutants generated by industrial and vehicle emissions. Certain specialized environments entail a greater risk of contamination in ambient air, e.g. construction sites and mines with respect to particulate matter, and hospitals with respect to viral and bacterial agents.

These concerns have led to development of a wide variety of masks, typically designed to cover the nose and mouth of the user. These masks frequently are ineffective due to perimeter leakage between the mask and face. Individuals who might benefit from the masks frequently refuse to wear them, due to discomfort or dissatisfaction with the appearance of the mask. Moreover, the masks tend to trap exhaled carbon dioxide, especially when the mask includes a fine (microporous) filter and forms a tight seal against the face. The longer the mask is worn, the greater is the tendency for buildup of carbon dioxide. The user, inhaling increasing amounts of carbon dioxide, is subject to headaches, drowsiness, and nausea, with prolonged exposure causing more severe effects.

To address these concerns, a variety of filtering devices have been proposed for insertion into nasal cavities. For example, U.S. Pat. No. 216,694 (Chen) shows a filter with a pair of plug units joined by a belt section, each plug unit receiving a filter. Similarly, U.S. Pat. No. 2,433,565 (Korman) describes a filter in which nostril inserts are joined by a bridge piece. Each insert contains a filter and a porous cone that can be used to deliver medication. In these devices, cylindrical or conical support structures surround the filtering media and press against the inside surface of the nasal wall and septum, frictionally retaining the filter. This support may be supplemented by an adhesive. In either event the supporting structure, which is impermeable to air flow, presses against the nasal wall and tends to mat the turbinates and nose hairs, thus diminishing the capacity of the nostril to trap particles, and warm and moisten incoming air. The filtering devices may satisfactorily perform the particle trapping function, but are not well adapted to warm and moisten the incoming air.

In an alternative approach, U.S. Pat. No. 5,392,773 (Bertrand) discloses a filter mounted outside the nasal cavities, secured to the nasal wall with an adhesive. The appearance of the filter, and the need for an adhesive, are disadvantages to this approach.

Further, regardless of whether the foregoing nasal filters are mounted outside the nose or inserted into the nasal cavities, they afford a relatively small surface area for filtration, limited by the size of the openings into the nostrils. Thus, they tend to plug quickly and require frequent replacement, especially on construction sites and in other environments with high particulate concentrations. Finally, the nasal filters afford no protection against intentional or inadvertent inhaling through the mouth.

Therefore, it is an object of the present invention to provide a breathing air filtration device with filtering media insertable into the nasal cavities, yet with substantially larger surface areas for filtration.

Another object is to provide a filtration device with a support structure that maintains a filtering medium inside a nasal cavity and in spaced-apart relation to the nasal wall, to provide effective filtration while reducing interference with the particle trapping, air warming and air moistening functions of the nasal interior wall.

A further object is to provide a filtration system that effectively filters air entering the nose and mouth, and at the same time considerably reduces the volume available for trapping exhaled carbon dioxide as compared to masks that cover the nose and mouth.

Yet another object is to provide a nasal filter that is convenient to use, affords longer lasting and more effective filtration, and has a minimal impact on the user's appearance.

SUMMARY OF THE INVENTION

To achieve these and other objects, there is provided a breathing air filtration device. The device includes a concave-convex first filtering medium having a first rim at an open proximal end thereof defining a first opening surrounded by the first rim. A concave-convex second filtering medium has a second rim at an open proximal end thereof defining a second opening surrounded by the second rim. The filtration device has a support structure including a first base member coupled integrally with respect to the first rim to support the first filtering medium, and a second base member coupled integrally to the second rim to support the second filtering medium. A connecting member is coupled integrally to the first base member and the second base member and extends between the base members. The support structure base members are positionable at the nasal cavity entrance, with the connecting member spanning the septum. This places each of the first and second filtering media in a working position in which the filtering medium projects distally into an associated one of the nasal cavities. Thus, air entering each nasal cavity passes through the associated one of the first and second openings, and further passes through the associated one of the first and second filtering media.

Preferably, each filtering medium in its working position is spaced apart from the septum and from the nasal wall defining the associated nasal cavity. This result may be achieved by using a filtering medium that is substantially self-supporting, or by disposing an open frame between a more pliable filtering medium and the nasal wall. In either event, this arrangement provides increased comfort, and facilitates the flow of incoming air along the inside surface of the nasal wall, to effectively warm and moisturize the air when the filtering device is in place.

The filtering media can have ellipsoidal shapes, to more readily conform to the nostrils and nasal cavities. Alternatively, each filtering medium can have a truncated-conical shape, preferably modified to exhibit elliptical profiles in transverse planes.

Whether conical or ellipsoidal, the filtering media afford a considerably increased area available for filtration as compared to a filtering medium with a planar surface at the nasal cavity entrance. The magnitude of this advantage can be appreciated when considering the surface area of a hemisphere, as compared to a disk of the same radius. The hemisphere surface area is twice as large. The ellipsoidal and elliptical/conical filtering media can be configured to enhance the advantage, providing effective surface areas well over twice the area of the entrance to the nasal cavity.

The present invention may be embodied in a two-stage device, in which a first screening component is mounted with respect to the first base member and disposed proximally of the first filtering medium, and a second screening component is similarly mounted with respect to the second base member. The screening component can comprise a relatively coarse (larger porosity) activated charcoal filter intended to remove odors and larger particles. This prevents the larger particles from reaching the downstream filtering media, extending their useful life.

In certain environments, it is vital to insure against inhaling contaminants through the mouth as well as the nose. To this end, the device is augmented with a third base member positionable against the face in surrounding relation to the mouth to form an opening through which air can enter the mouth, and a third filtering medium mounted with respect to the third base member and dispose over the opening. If desired, the third filtering medium can be concaved-convex and project away from the mouth in the proximal direction. A flexible band or other retainer is used to releasably maintain the third base member against the user's face.

As compared to a mask filter covering the nose and mouth, the combination of separate nose and mouth filters is less cumbersome, less prone to leakage at the filtering device perimeter, and has a smaller enclosed volume near the face, and therefore is less prone to accumulation of exhaled carbon dioxide. If the user inhales substantially exclusively through the nose, problems due to carbon dioxide accumulation are avoided altogether.

In accordance with another aspect of the invention, there is provided a nasal air filtering device. The device includes a first filter and a second filter, both having respective first and second proximal ends and adapted for insertion into a nasal cavity. The device also includes a filter support structure including a first base member coupled with respect to the first proximal end and supporting the first filter, a second base member coupled with respect to the second proximal end and supporting the second filter, and a connecting member integrally coupled to the base members and extended between the base members. The base members of the filter support structure are positionable at the entrances to the nasal cavities, with the connecting member spanning the septum, thus to place each filter in a working position in which the filter projects distally into an associated one of the nasal cavities, and is spaced apart from the nasal wall that defines the associated cavity, thus to define a passage for accommodating air flow between the filter and the nasal wall.

If desired, each filter can be concave in the proximal direction and convex in the distal direction. The filter may be self-supporting and thus stand spaced apart from the nasal wall by virtue of its coupling to the associated base member. Alternatively, an open frame can be coupled to the base member and disposed between the filter and the nasal wall, to maintain the desired spacing.

Thus in accordance with the present invention, a filtration device insertable into the nasal cavities is easy to use, has a minimal impact on the appearance of the user, and provides more effective and longer-lasting filtration. Improved performance arises in part from the retention of air warming and moisturizing capability when the filtering media are maintained in the spaced-apart relation to the nasal walls. Improved performance also arises from a considerably enlarged surface area available for filtration, due to the concave-convex shape of the filtering media, and further if desired by forming the media with corrugations. Finally, the nasal filter can be combined with an auxiliary filter covering the mouth, to provide a combined filtration system which, compared to a conventional mask, is less prone to perimeter leakage and accumulation of exhaled carbon dioxide.

IN THE DRAWINGS

For a further appreciation of the above and other features and advantages, reference is made to the following detailed description and to the drawings, in which.

DETAILED DESCRIPTION OF THE PREFERRED EMBODIMENTS

Figure 1:
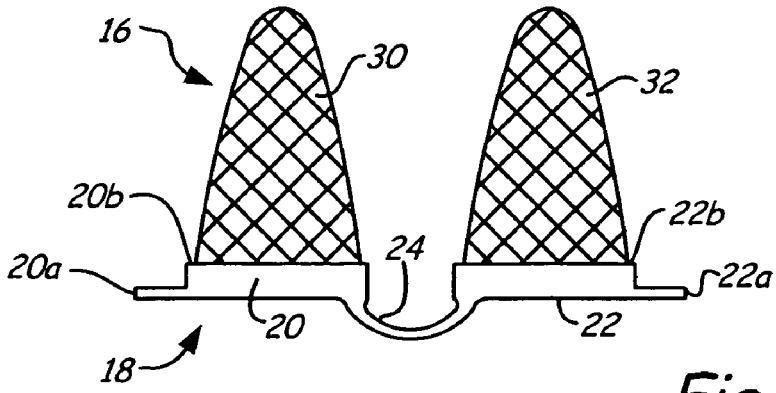
FIG. 1 is a forward elevational view showing a nasal air filtration device constructed in accordance with the present invention.

Turning now to the drawings, there is shown in FIG. 1 a nasal air filtering device 16 insertable into the nasal cavities to filter ambient air as it is inhaled by the user. Device 16 includes a unitary support structure or panel 18, preferably formed of a hypo-allergenic material such as polyvinyl chloride (PVC) or polyurethane. The panel is structurally self-supporting and further is flexible and compliant so that it readily conforms to the anterior surface of the nose, in particular the anterior nares and septum, when device 16 is in use.

Figure 2:
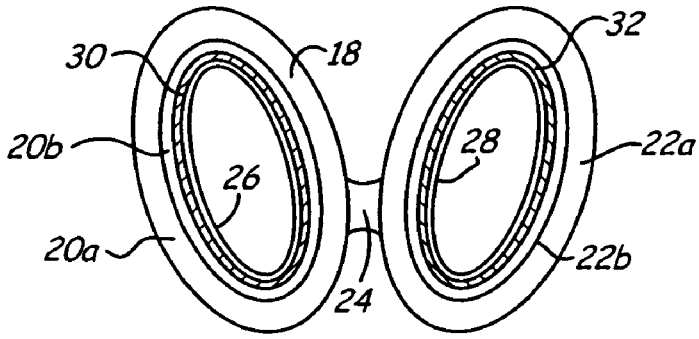
FIG. 2 is a sectional view taken along the line 2—2 in FIG. 1.
Figure 3:
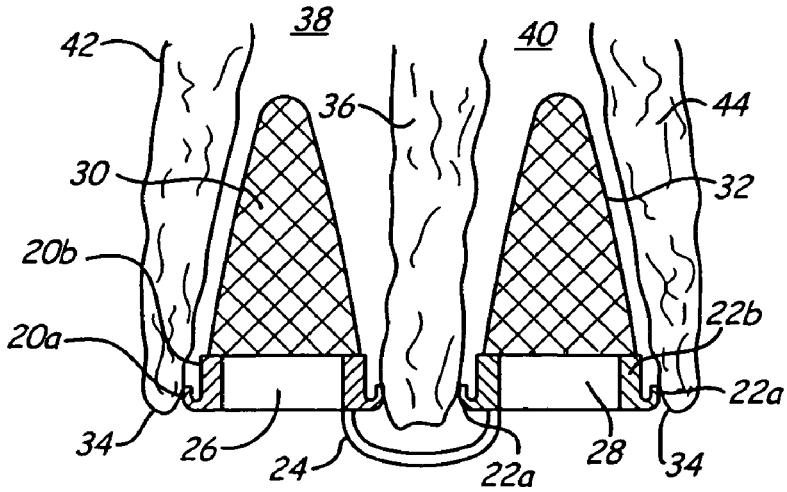
FIG. 3 is a schematic view of the device in use.

Panel 18 includes a base 20, an opposite base 22, and a connecting member or bridge 24 coupled to the bases to maintain the bases spaced apart from one another a desired distance. Each of the bases is annular—more precisely, generally annular in sense that its profile is somewhat elliptical rather than circular. Bases 20 and 22 have respective closed or endless perimeter regions 20*a* and 22*a*, and shoulders 20*b* and 22*b* that surround openings through the base, to admit air when the device is in use. As seen in FIGS. 2 and 3, openings 26 and 28 are formed through bases 20 and 22, respectively. Bridge 24 is relatively narrow to provide bending flexibility along the bridge. Base perimeter regions 20*a*/22*b* are thin and flexible, while shoulders 20*b*/22*b* are more rigid.

A generally conical filtering medium or filter 30 is mounted on base 20, and a similar filter 32 is mounted on base 22. Each filter is mounted to its associated base along a generally annular proximal edge or rim and extends away from the base to a distal apex. In use, filters 30 and 32 extend distally into the nasal cavities. Each of the filters can be attached to its associated one of shoulders 20*b* and 22*b* with a suitable adhesive.

Filters 30 and 32 can be formed from a wide variety of materials, and further can be formed with a wide (several orders of magnitude) range of porosities, depending on the nature of the contaminants to be filtered. Materials and porosities can be selected in accordance with National Institute for Occupational Safety and Health (NIOSH) classifications, e.g. dusts, mists and fumes (DMF), or high-efficiency particulate air (HEPA) filters. Suitable materials include natural fabrics such as cotton, and polymeric materials such as nylon, polyethylene and polypropylene. Hypoallergenic materials such as PVC and polyurethane also may be employed. Each of the filters has a substantially uniform thickness, and in general has a truncated conical shape, although differing from a precise truncated cone in two respects. With reference to filter 30, the distal end near the apex forms a rounded dome, rather than a transverse plane. Second, profiles of filter 30 taken in transverse planes are elliptical rather than circular, to provide a filter shape that better conforms to the nasal cavity. Filter 32 is similarly shaped.

FIG. 2 shows the elliptical profiles of filters 30 and 32, and further illustrates a preferred angular orientation of the filters and bases relative to each other. Bridge 24 maintains the preferred orientation as well as maintaining the bases and filters in a desired spaced-apart relation to each other. In this orientation, the long or lengthwise axes of the respective ellipsis are not parallel, but maintained at an angle, e.g., about 30 degrees. As a result, filters 30 and 32 are angularly oriented in a manner that better conforms to the relative angular orientation of the nostrils and nasal cavities, thus to provide a closer, more comfortable fit of the filters within the nasal cavities. The bridge is sufficiently flexible to allow limited adjustment of the angle to suit the person wearing the device.

As seen in FIG. 3, perimeter regions 20*a* and 22*a* are positionable at the entrances 34 to nasal cavities 38 and 40, with bridge 24 spanning the septum 36. This forms a close fit in which the perimeter regions tend to conform to the nasal cavity entrances, forming a contiguous surface engagement that frictionally maintains each filter within its associated nasal cavity, and preferably provides a seal. Shoulders 20*b* and 22*b* extend into the nasal cavities 38 and 40, spaced apart from the nasal wall interior. This places each of filters 30 and 32 in a working position in which the filter extends distally into its associated nasal cavity: filter 30 into nasal cavity 38, and filter 32 into nasal cavity 40. The width (radial dimension) and thickness (axial dimension) of perimeter regions 20*a* and 22*a* can vary with the material forming panel 18. In general, these dimensions are selected to provide each perimeter region with sufficient bending flexibility to conform to the nasal wall at the entrance to the nasal cavity and form the desired seal, and also with sufficient structural rigidity and strength to frictionally support the associated base and filter in their associated nasal cavity. To facilitate this dual function, the perimeter regions can be tapered to provide a thickness that decreases in the radially outward direction.

As a result of this positioning, and the close fit between bases 20 and 22 and the nasal cavities, air entering nasal cavity 38 enters through opening 26 and passes through filter 30. Likewise, air enters nasal cavity 40 through opening 28, and proceeds through filter 32.

Bridge 24 sets the desired spacing between bases 20 and 22, and thus facilitates proper positioning of filters 30 and 32 in their respective nasal cavities. The bridge also prevents over insertion of the filters by virtue of its contact with the septum, and remains easily accessible to the user desiring to remove filtering device 16 after use. Further, as best seen in FIG. 2, bridge 24 determines the desired relative angular orientation of bases 20 and 22, and thus of filters 30 and 32.

Filtering device 16 affords several advantages in comparison to the aforementioned conventional nasal filters. One of these arises from the concave-convex shape of filters 30 and 32. Each of the filters has a concave inside surface in the proximal (out of the nasal cavity) direction, and a convex exterior surface in the distal (into the nasal cavity) direction. As compared to a conventional arrangement including disk-shaped filters with surface areas comparable to openings 26 and 28, or higher volume filters that nonetheless are exposed only along openings such as 26 and 28, filters 30 and 32 have a much larger surface area available for filtration.

The magnitude of this difference can be understood when considering a filter shaped as a disk, compared to a filter having the same radius but shaped as a hemispherical shell. The surface area of the disk is $\pi r^2$. The surface area of the hemispherical shell is $2\pi r^2$. The concavity in this instance doubles the surface area available for filtration. In the case of filters 30 and 32, this advantage is magnified, because the distance from the rim of each filter to its apex is considerably larger than the radius of the rim.

Another advantageous feature is the fact that filters 30 and 32 are sufficiently structurally self-supporting to stand alone, and are not surrounded by an air-impermeable cylinder or barrel, as is the case with the conventional filtering arrangements. Inhaled air readily passes through the entire filter, not just at or near the apex.

In short, the concave-convex shape, in the absence of air-impermeable structure contacting and surrounding the filter, leads to a considerable increase in the surface area available for filtration. Even a slight degree of concavity can increase the available surface area by fifty percent. More preferably, the available surface area is at least doubled as compared to a planar filter at the nasal cavity entrance.

Another salient advantage resides in the spaced-apart relation of each filter to the nasal wall defining the nasal cavity. More particularly, filter 30, for example, is spaced apart from septum 36 and the nasal wall 42 that cooperates with the septum to surround the filter. Filter 32 likewise is spaced apart from septum 36 and a nasal wall 44. This spacing promotes the flow of inhaled air along the space between each filter and its surrounding nasal tissue. Perhaps more importantly, this spacing has a favorable impact on the capacity of the nasal wall to warm and moisten inhaled air. Nasal hairs and turbinates are exposed, rather than matted down by the filter, or by an air-impermeable cylinder surrounding a filter. Thus, filtering device 16, as compared to prior filters, more effectively preserves the air warming and air moisturizing capability of the nasal cavity.

Figure 4:
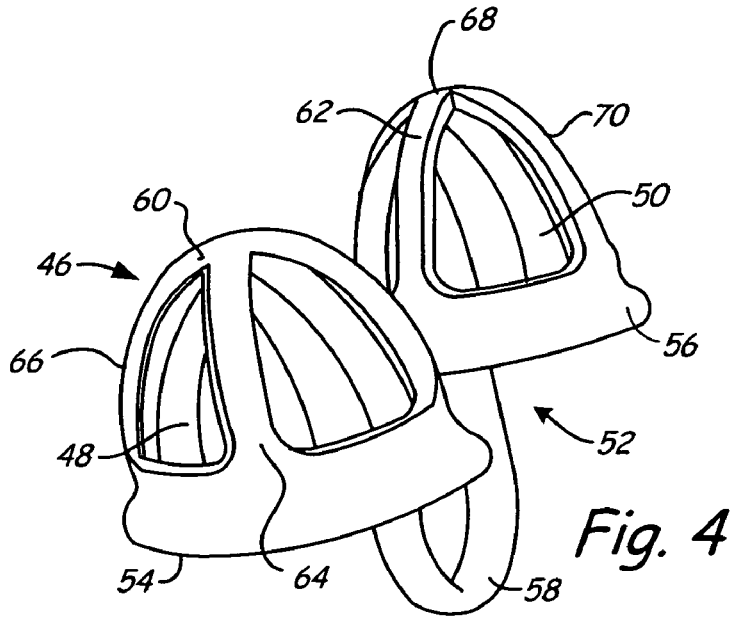
FIG. 4 is a perspective view of an alternative embodiment filtration device.
Figure 5:
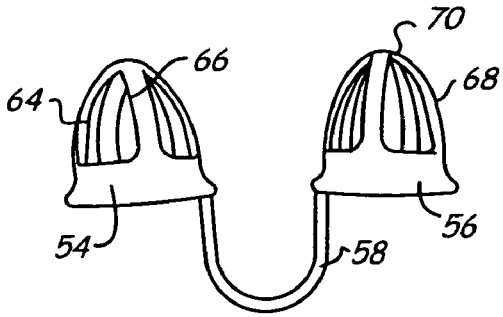
FIG. 5 is a forward elevation of the device shown in FIG. 4.

FIG. 4 illustrates an alternative filtering device 46 including a pair of ellipsoidal and corrugated filters 48 and 50 contained within a unitary support structure 52. The support structure is comparable to panel 18 in that it includes bases 54 and 56, and a bridge 58 coupled to the bases to maintain the desired spacing and angular relationship. Bridge 58 is u-shaped to allow a further distal insertion of the filters into their respective nasal cavity. Accordingly, filters 48 and 50 are shorter than filters 30 and 32, in terms of the axial distance between the rim and the apex. Further, however, an open frame 60 extends distally from base 54, and an open frame 62 extends distally from base 56. Frame 60 consists of arched, intersecting frame members 64 and 66, and frame 62 similarly consists of an intersecting pair of arched frame members 68 and 70. Each filter is contained within its associated base and frame. Frames 60 and 62 are relatively rigid, while the perimeter regions of bases 54 and 56 are more flexible to form a better seal against the anterior nares. Filters 48 and 50 need not be structurally self-supporting, due to the surrounding open frames.

Figure 6:
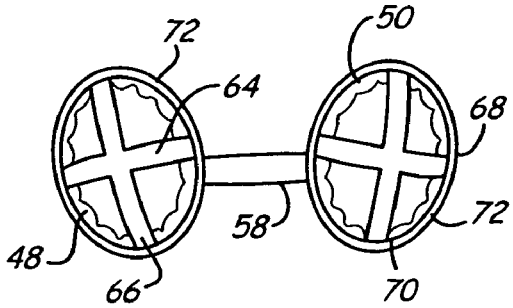
FIG. 6 is a top plan view showing the device of FIG. 4.

As perhaps best seen in FIG. 6, bridge 58 maintains bases 54 and 56, and thus filters 48 and 50 as well, in a preferred angular offset relative to each other. Multiple corrugations 72 are formed in each filter, beginning at the rim and extending upwardly toward the apex. The corrugations strengthen each filter in terms of increasing its rigidity. Further, the corrugated filter, as compared to a filter of the same size without the corrugations, has an increased surface area available for filtration.

Figure 7:
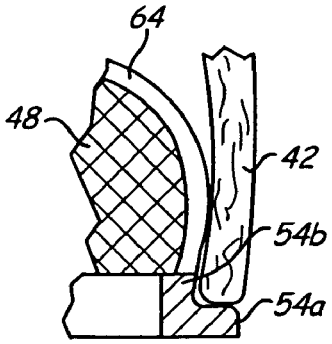
FIGS. 7 and 8 are schematic views illustrating operation of the device of FIG. 4.
Figure 8:
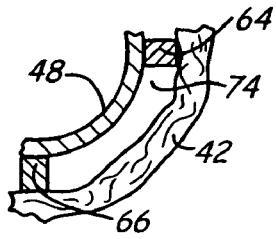

As seen from FIGS. 7 and 8, filter 48 is frictionally retained in its associated nasal cavity, by contact of frame members 64 and 66 and a shoulder 54*b* with the surrounding nasal wall. In this arrangement, which is different from that shown in FIG. 3, a perimeter region 54*a* is positioned against the anterior nares, and thus remains outside of the nasal cavity. The frame members cooperate to maintain their associated filter in spaced-apart relation to the surrounding nasal wall, forming a plurality of air flow passages between the filter and wall as indicated by a passage 74 formed by frame members 64 and 66. Filter 50 and base 56 are similarly supported. The passages facilitate a flow of inhaled air through each of filters 48 and 50 toward the nasal wall, then along the nasal wall and eventually past the filter. As before, this spacing facilitates the warming and moisturizing of inhaled air.

If desired, bases 54 and 56 can be formed with respective perimeter regions 54*a* and 54*b* sized for insertion into the nasal cavity entrances, to support their associated filters and bases in the manner illustrated in FIG. 3. In this approach, open frames 60 and 62 do not contribute to the frictional retention of the bases and filters, but instead tend to remain spaced apart from the interior nasal walls and septum. This arrangement requires a more precise sizing of the proximal regions of the bases. The primary advantage is that bases with bendable, compliant perimeter regions can form a satisfactory seal and frictional hold over a wider range of nasal cavity sizes and shapes.

Figure 9:
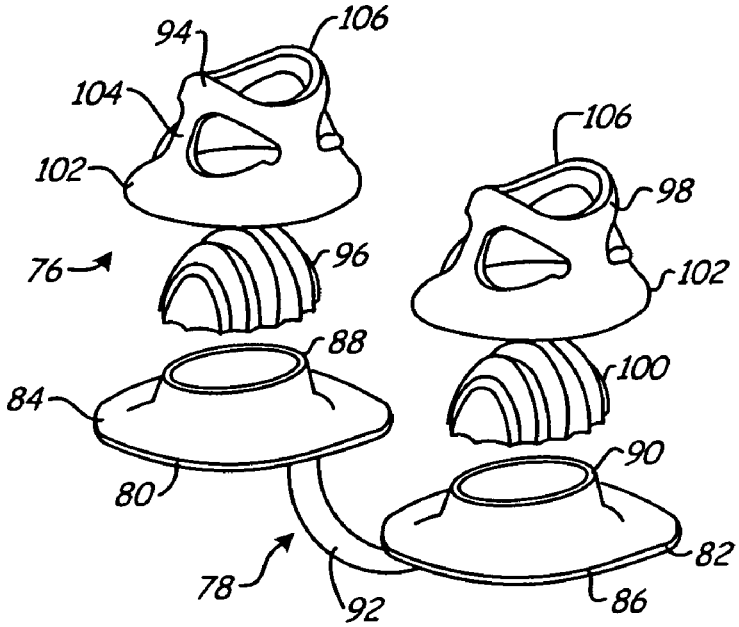
FIG. 9 is an exploded-parts view of another alternative embodiment filtration device.
Figure 10:
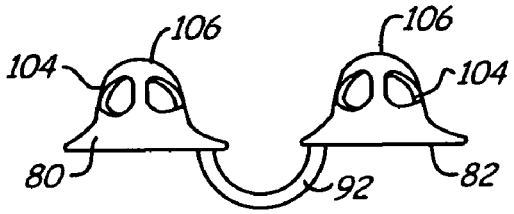
FIG. 10 is a forward elevational view showing the device of FIG. 9.
Figure 11:
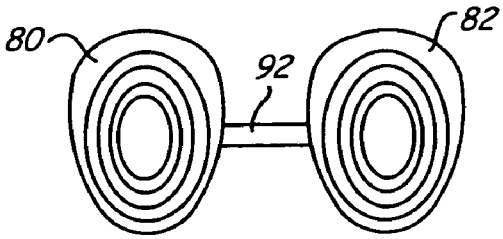
FIG. 11 is a top plan view of the device of FIG. 9.

FIG. 9 is an exploded-parts view of a further alternative embodiment nasal filtration device 76. Device 76 includes a filter support structure 78 having spaced apart bases 80 and 82 with relatively flat and generally annular perimeter portions 84 and 86 respectively, and respective raised and generally annular shoulders 88 and 90. The bases are coupled by an arcuate bridge 92.

An open-frame retainer 94, shown above base 80, can be removably press-fit onto the base to capture an ellipsoidal, corrugated filtering medium 96. An open-frame retainer 98 can be similarly coupled to base 82, to contain an ellipsoidal, corrugated filtering medium 100. Each of the retainers includes a generally annular bottom portion 102 sized and shaped for a press-fit coupling with the shoulder of its associated base. Each retainer further incorporates several frame members 104, shorter than frame members 64–70 and extending to an open top 106 of the retainer, rather than to an apex or junction of the frame members as with device 46. Frame members 104, like the frame members in device 46, contact the nasal wall to provide frictional mounting of the device, and maintain their associated filters in spaced-apart relation to the nasal wall to promote air flow between each retainer and the nasal wall that surrounds it.

Figure 12:
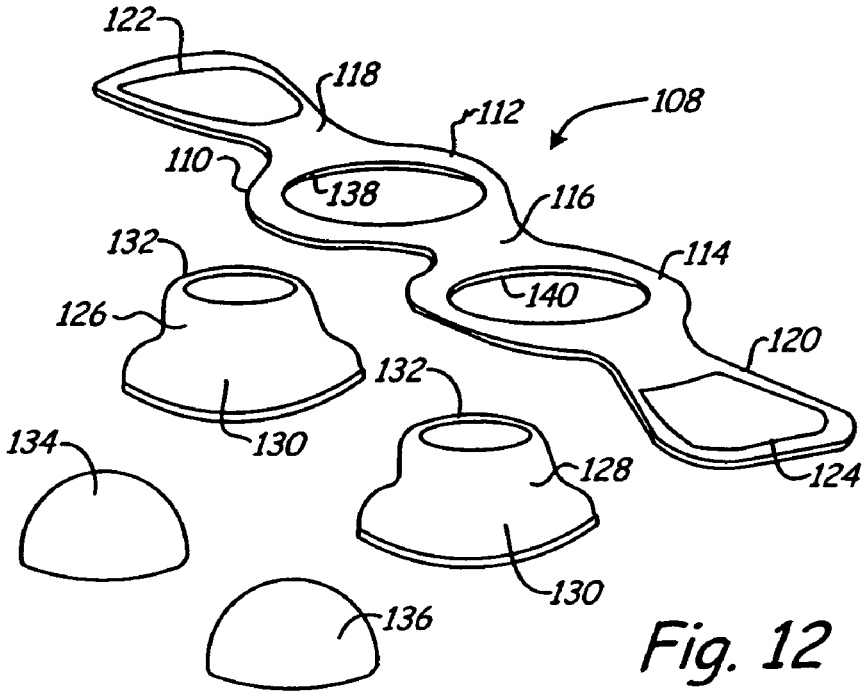
FIG. 12 is an exploded-parts view of another alternative embodiment filtration device.

FIG. 12 is an exploded-parts view of yet another alternative embodiment filtration device 108. The support structure is provided in the form of a flat, thin, flexible panel 110 that incorporates base portions 112 and 114 joined by a bridge portion 116. The panel further incorporates a tab 118 extending away from base portion 112, and a tab 120 extending in the opposite direction away from base portion 114. An adhesive pad is applied to each tab, as indicated at 122 and 124. The device further includes a pair of filter containers 126 and 128, each domain-shaped with a relatively wide generally annular bottom rim portion 130, and a large opening 132 at the top. Ellipsoidal filters 134 and 136 are shown beneath the containers.

Figure 13:
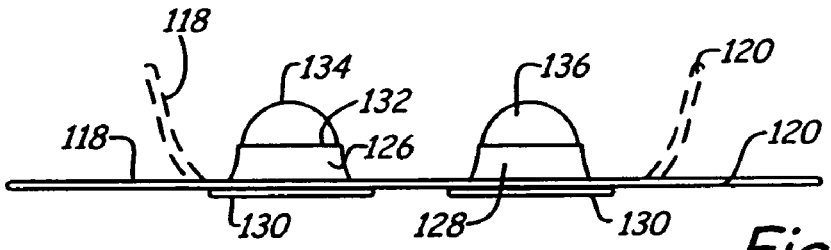
FIG. 13 is a forward elevational view of the device of FIG. 12.
Figure 14:
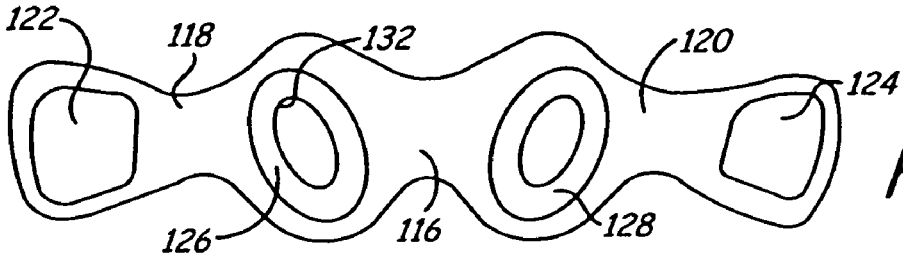
FIG. 14 is a top plan view of the device of FIG. 12.

Filters 134 and 136 are press-fit into containers 126 and 128, which in turn are inserted through respective openings 138 and 140 in panel 110 until the bottom rim portion 130 of each container is contiguous with one of base portions 112 and 114. The result is shown in FIG. 13. Broken lines in this figure illustrate how the flexible panel can be folded to direct tabs 118 and 120 upwardly. When the filters and containers are inserted into the nasal cavities, this positions the tabs along the lateral portions of the nasal walls. The adhesive pads are used to removably retain the tabs against the lateral nasal walls, to maintain panel 110 against the anterior nares and maintain filters 134 and 136 in the working position. In an alternative of this embodiment, self-supporting filters are used in lieu of the filter/container pairs.

Figure 15:
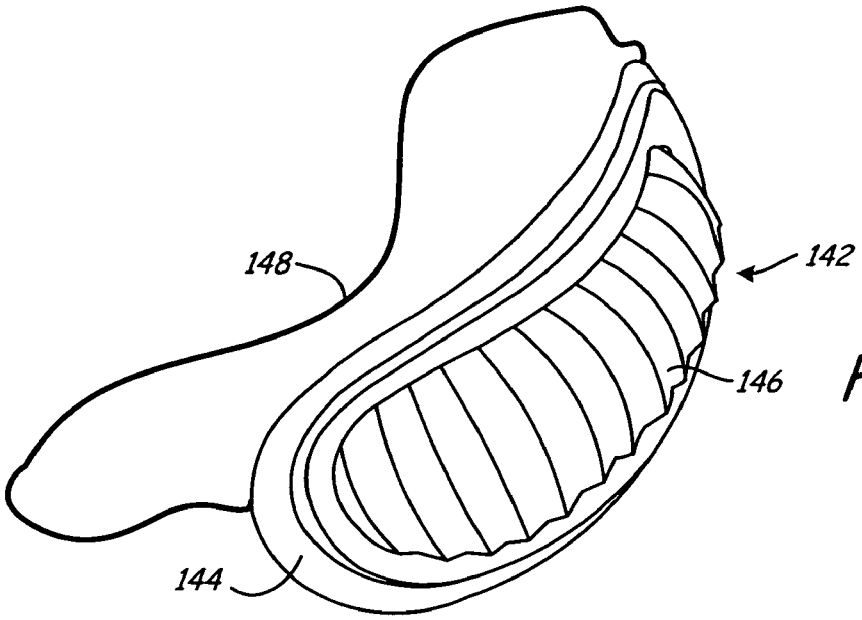
FIG. 15 is a perspective view of an air filtration device adapted to cover the mouth.

FIG. 15 shows a breathing air filtration device 142 designed to cover the mouth. The device includes a concave-convex base 144 with a concave surface designed to facilitate a close, preferably sealing surface engagement with the face of the user, in surrounding relation to the user's mouth. A filtering medium 146 is mounted to the base, secured to the base by an adhesive along its perimeter if desired. An elastic band 148 is secured at its ends to opposite sides of base 144. Filtering medium 146 is corrugated, and concave-convex with the outside or proximal side being convex.

Figure 16:
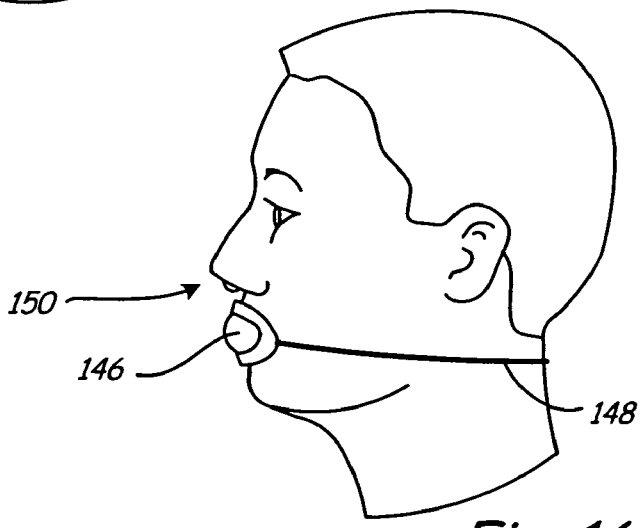
FIG. 16 is a side elevational view illustrating use of an alternative embodiment filtration system including the device of FIG. 15 in combination with a nasal filter.

As seen in FIG. 16, filtering device 142, in combination with one of the nasal filtering devices previously described, are worn in combination to provide an air filtration system 150 for use in lieu of a conventional mask filtration device covering the mouth and nose. As compared to a single mask, system 150 is less prone to leakage, due in part to the shorter and more consistent contour of the face in contact with base 144. Also, because band 148 is aligned with the mouth rather than the mouth and nose, it tends to assume a lower position around the neck and is less prone to downward slippage. System 150 encloses a volume of air near the mouth, but this volume is considerably less than the volume near the mouth and nose enclosed by a conventional mask. Thus, the volume available for entrapment of exhaled carbon dioxide is reduced. System 150 is adapted to virtually eliminate carbon dioxide accumulation altogether, by a user's inhaling exclusively through the nose. In addition to a better fit, system 150 is less prone to perimeter leakage.

Figure 17:
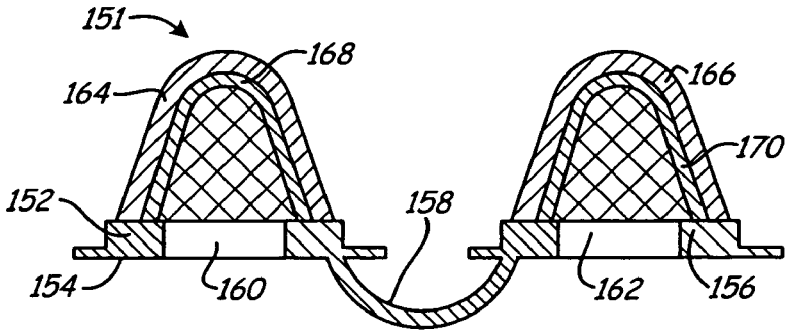
FIG. 17 is a schematic view of another alternative embodiment filtration device.

FIG. 17 illustrates another alternative embodiment filter, in the form of a two-stage nasal air filtering device 151. The device includes a flexible panel 152, including a base 154, an opposite base 156, and a bridge 158 connecting the bases in the same manner as the bridges in previous embodiments. Two generally elliptical openings are formed through the panel, including an opening 160 through base 154, and an opening 162 through base 156. In a manner similar to previous embodiments, base 154 supports an ellipsoidal filtering medium 164, and base 156 supports an ellipsoidal filtering medium 166. In addition, each of bases 154 and 156 supports an ellipsoidal preliminary screening filter: a screening filtering medium 168 in opening 160, and a screening filtering medium 170 in opening 162.

Device 151 provides two filtration stages, as inhaled air passes through one of filtering media 168 and 170, then through one of filtering media 164 and 166. In one preferred version, media 168 and 170 are relatively coarse activated charcoal filters, and filtering media 164 and 166 are finer (micropore) filters formed of polymeric fibers. Filters 168 and 170 screen out larger particles, and remove odors from the incoming air. This prevents the larger diameter particles from impacting and collecting over the ellipsoidal filters, lengthening their useful life.

Thus in accordance with the present invention, a breathing air filtration device is insertable into the nasal cavities for improved, longer lasting filtration of inhaled air. The enhanced surface area available for filtration lengthens the useful operation of the device. The area for filtration is enhanced by the concave-convex design of the filtering media, and can be further improved by corrugating the media. Filtering is improved by a selective positioning of the filters in spaced-apart relation to the surrounding nasal walls, resulting in more effective warming and moisturizing of the filtered air. The nasal filtering device also is effective in combination with an auxiliary filter covering the mouth, to provide a system suitable for use in lieu of a conventional mask, with improved resistance to perimeter leakage and accumulation of exhaled carbon dioxide.

What is claimed is:

1. A breathing air filtration device, including:

a concave-convex first filtering medium having a first rim at a proximal end thereof and defining a first opening surrounded by the first rim;

a concave-convex second filtering medium having a second rim at a proximal end thereof and defining a second opening surrounded by the second rim;

a support structure including a first base member coupled integrally with respect to the first rim to support the first filtering medium, a second base member coupled integrally to the second rim to support the second filtering medium, and a connecting member coupled integrally to the first base member and the second base member and extended between the first and second base members; and a first open frame extending distally from the first base member, and a second open frame extending distally from the second base member;

wherein the base members of the support structure are positionable at the nasal cavity entrances, with the connecting member spanning the septum, to place each of the first and second filtering media in a working position in which the filtering medium projects distally into an associated one of the nasal cavities, whereby air entering each nasal cavity passes through the associated one of the first and second openings, and further passes through the associated one of the first and second filtering media, and wherein each of the open frames is disposed between its associated filtering medium and associated nasal wall when the associated filtering medium is in the working position.

2. The device of claim 1 wherein:

each of the filtering media is structurally self supporting.

3. The device of claim 1 wherein:

the first and second base members are formed of a first polymeric material, and the open frames are formed of a second polymeric material more rigid than the first polymeric material.

4. The device of claim 1 wherein:

each of the open frames is releasably coupled to its associated base member.

5. The device of claim 4 wherein:

each associated base member and frame cooperate to contain their associated filtering medium when releasably coupled.

6. The device of claim 1 wherein:

each of the filtering media has an ellipsoidal shape.

7. The device of claim 6 wherein:

the connecting member tends to maintain the first and second base members in a selected angular orientation relative to one another.

8. The device of claim 1 wherein:

each of the filtering media has a truncated-conical shape.

9. The device of claim 1 wherein:

the first and second filtering media are corrugated.

10. The device of claim 1 wherein:

each of the base members is generally annular and sized for correspondence with the rim of its associated filtering medium.

11. The device of claim 1 wherein:

each of the first and second filtering media over a convex surface thereof has a surface area at least 1.5 times its associated one of the first and second openings.

12. The device of claim 1 further including:

first and second screening components associated with the first and second filtering media, respectively, wherein each screening component is mounted with respect to its associated base member and disposed proximally of the associated filtering medium.

13. The device of claim 1 wherein:

the base members, when positioned at the entrances to the nasal cavities, tend to compliantly conform to the nasal surface.

14. A nasal air filtration device, including:

a first filter having an open first proximal end and a distal end, adapted for insertion into a nasal cavity;

a second filter having an open second proximal end and a distal end, adapted for insertion into a nasal cavity;

and a filter support structure including a first base member coupled with respect to the first proximal end and supporting the first filter, a second base member coupled with respect to the second proximal end and supporting the second filter, and a connecting member integrally coupled with respect to the first and second base members and extended between the base members; and a first open frame extended distally from the first base member, and a second open frame extended distally from the second base member;

wherein the base members of the filter support structure are positionable at the entrances to the nasal cavities, with the connecting member spanning the septum, to place each of the first and second filters in a working position in which the filter projects distally into an associated one of the nasal cavities, and is spaced apart from the nasal wall defining its associated nasal cavity to define a passage for accommodating air flow between the filter and the nasal wall, and wherein each of the open frames is disposed between its associated filter and the nasal wall in the working position.

15. The device of claim 14 wherein:

each of the filters is concave in the proximal direction, and convex in the distal direction.

16. The device of claim 15 wherein:

each of the filters has an ellipsoidal shape.

17. The device of claim 16 wherein:

the connecting member tends to maintain the first and second base members in a selected angular orientation relative to one another.

18. The device of claim 15 wherein:

each of the filters has a truncated-conical shape.

19. The device of claim 14 wherein:

each of the first and second filters is structurally self supporting.

20. The device of claim 14 wherein:

each of the filters is corrugated.

21. The device of claim 14 wherein:

each of the first and second open frames is releasably coupled to its associated base member, and adapted to contain the associated filter when so coupled.

22. The device of claim 14 wherein:

each of the base members is generally annular, and has a size and shape corresponding to an entrance to its associated nasal cavity.

23. The device of claim 22 wherein:

the base members, when positioned at the entrances to the nasal cavities, tend to compliantly conform to the nasal surface.

24. A breathing air filtration device, including: a concave-convex first filtering medium having a first rim at a proximal end thereof and defining a first opening surrounded by the first rim;

a concave-convex second filtering medium having a second rim at a proximal end thereof and defining a second opening surrounded by the second rim; and a support structure including a first base member coupled integrally with respect to the first rim to support the first filtering medium, a second base member coupled integrally to the second rim to support the second filtering medium, a connecting member coupled integrally to the first base member and the second base member and extended between the first and second base members, and first and second tabs associated with the first and second base members, respectively, and extending in opposite directions away from the associated base members; wherein the base members of the support structure are positionable at the nasal cavity entrances, with the connecting member spanning the septum, to place each of the first and second filtering media in a working position in which the filtering medium projects distally into an associated one of the nasal cavities, whereby air entering each nasal cavity passes through the associated one of the first and second openings, and further passes through the associated one of the first and second filtering media.

25. The device of claim 24 further including:

an adhesive applied to the first and second tabs, to facilitate a removable attachment of the tabs to opposite lateral nasal walls.

26. A breathing air filtration device, including:

a concave-convex first filtering medium having a first rim at a proximal end thereof and defining a first opening surrounded by the first rim;

a concave-convex second filtering medium having a second rim at a proximal end thereof and defining a second opening surrounded by the second rim;

a support structure including a first base member coupled integrally with respect to the first rim to support the first filtering medium, a second base member coupled integrally to the second rim to support the second filtering medium, and a connecting member coupled integrally to the first base member and the second base member and extended between the first and second base members; and a third base member positionable against a face in surrounding relation to a mouth and defining an air flow opening coincident with the mouth, and a third filtering medium mounted to the third base member and disposed over the air flow opening;

wherein the base members of the support structure are positionable at the nasal cavity entrances, with the connecting member spanning the septum, to place each of the first and second filtering media in a working position in which the filtering medium projects distally into an associated one of the nasal cavities, whereby air entering each nasal cavity passes through the associated one of the first and second openings, and further passes through the associated one of the first and second filtering media.

27. The device of claim 26 wherein:

the third filtering medium is concave-convex and projects away from the mouth in the proximal direction.

28. The device of claim 26 further including:

a retainer for releasably maintaining the third base member against the face.

29. A nasal air filtration device, including: a first filter having an open first proximal end and a distal end, adapted for insertion into a nasal cavity; a second filter having an open second proximal end and a distal end, adapted for insertion into a nasal cavity; and a filter support structure including a first base member coupled with respect to the first proximal end and supporting the first filter, a second base member coupled with respect to the second proximal end and supporting the second filter, a connecting member integrally coupled with respect to the first and second base members and extended between the base members, and first and second tabs associated with the first and second base members, respectively, and extended in opposite directions away from their associated base members;

wherein the base members of the filter support structure are positionable at the entrances to the nasal cavities, with the connecting member spanning the septum, to place each of the first and second filters in a working position in which the filter projects distally into an associated one of the nasal cavities, and is spaced apart from the nasal wall defining its associated nasal cavity to define a passage for accommodating air flow between the filter and the nasal wall.

30. The device of claim 29 further including:

an adhesive applied to the first and second tabs, to facilitate a releasable attachment of the tabs to a lateral exterior surface of the nasal wall.

31. A nasal air filtration device, including:

a first filter having an open first proximal end and a distal end, adapted for insertion into a nasal cavity;

a second filter having an open second proximal end and a distal end, adapted for insertion into a nasal cavity;

a filter support structure including a first base member coupled with respect to the first proximal end and supporting the first filter, a second base member coupled with respect to the second proximal end and supporting the second filter, a connecting member integrally coupled with respect to the first and second base members and extended between the base members; and a third base member adapted for positioning against a face in surrounding relation to a mouth, and defining an air flow opening coincident with the mouth, and a third filter mounted with respect to the third base member and disposed over the air flow opening;

wherein the base members of the filter support structure are positionable at the entrances to the nasal cavities, with the connecting member spanning the septum, to place each of the first and second filters in a working position in which the filter projects distally into an associated one of the nasal cavities, and is spaced apart from the nasal wall defining its associated nasal cavity to define a passage for accommodating air flow between the filter and the nasal wall.

32. The device of claim 31 further including:

a retainer for releasably maintaining the third base member in surface contact with the face.

33. A nasal air filtration device, including:

a first filter having a first proximal end and a first distal end, adapted for insertion into a nasal cavity;

a second filter having a second proximal end and a second distal end, adapted for insertion into a nasal cavity; and a filter support structure including a first base member disposed circumferentially about and supporting the first filter, a second base member disposed circumferentially about and supporting the second filter, and a connecting member integrally coupled to the first and second base members and extended between the base members, the first base member having a first perimeter region disposed circumferentially about the first base member and extending radially outward therefrom and the second base member having a second perimeter region disposed circumferentially about the second base member and extending radially outward therefrom;

wherein the first and second perimeter regions are positionable at entrances to the nasal cavities, forming a contiguous surface engagement with a nasal wall defining its associated nasal cavity, thereby maintaining the first and second base members substantially at the entrances to the nasal cavities, with the connecting member spanning the septum, to place each of the first and second filters in a working position in the nasal cavities.

* * * * *